US005163203A

United States Patent [19]

Tanasescu et al.

[11] Patent Number: 5,163,203

[45] Date of Patent: Nov. 17, 1992

[54] APPARATUS FOR WET CLEANING OF FLOORS

[76] Inventors: Ovidiu Tanasescu, Ateljévägen 10, S-172 41 Sundbyberg; Razvan Turcea, Östgötagatan 48, S-116 64 Stockholm both of Sweden

[21] Appl. No.: 678,294

[22] PCT Filed: Sep. 29, 1989

[86] PCT No.: PCT/SE89/00534

§ 371 Date: Apr. 5, 1991

§ 102(e) Date: Apr. 5, 1991

[87] PCT Pub. No.: WO90/03757

PCT Pub. Date: Apr. 19, 1990

[30] Foreign Application Priority Data

Oct. 6, 1988 [SE] Sweden ..... 8802895

[51] Int. Cl.[5] ..... A47L 11/293

[52] U.S. Cl. ..... 15/322; 15/320; 15/384; 15/385

[58] Field of Search ..... 15/320, 322, 384, 385

[56] References Cited

U.S. PATENT DOCUMENTS

| | | | |
|---|---|---|---|
| 1,211,948 | 1/1917 | Koster et al. | 15/384 |
| 1,821,715 | 9/1931 | Kuchinsky | 15/322 |
| 2,168,692 | 8/1939 | Vidal | 15/320 |
| 2,680,260 | 6/1954 | Danielsson et al. | 15/245 |
| 3,022,529 | 2/1962 | Bonfanti | 15/385 X |
| 3,189,930 | 6/1965 | Tuthill | 15/320 |
| 3,375,540 | 4/1968 | Hyde | 15/320 |
| 3,719,966 | 3/1973 | Lamont | 15/385 |

FOREIGN PATENT DOCUMENTS

| | | | |
|---|---|---|---|
| 1628859 | 7/1971 | Fed. Rep. of Germany . | |
| 2242260 | 4/1974 | Fed. Rep. of Germany . | |
| 2510233 | 9/1975 | Fed. Rep. of Germany . | |
| 319316 | 1/1972 | U.S.S.R. | 15/385 |

*Primary Examiner*—Chris K. Moore

*Attorney, Agent, or Firm*—Banner, Birch, McKie & Beckett

[57] ABSTRACT

An apparatus for the wet cleaning of floors and similar surfaces by use of a round rotating scrubbing brush powered by a motor. The brush has a centrally mounted outlet for dispensing clean water onto the floor to which detergent of a suitable kind is added. Surrounding the scrubbing brush is mounted an annular, non-rotating suction nozzle for removing dirty cleaning water from the floor. The nozzle is provided with radial openings, some of which are located at its inner circumference and oriented inwardly towards the scrubbing brush, and the remainder being located on the outer circumference and oriented outwardly towards a space arranged outside and around the nozzle. In the upper part of this space is mounted a ring, rotated by the motor, and provided with a plurality of openings for dispensing rinsing water, the openings being oriented towards the floor. The ring also has a plurality of lips on its outer perimeter extending therefrom to the floor, the lips being oriented to force, upon rotation of the ring, the rinsing water towards the openings at the outer circumference of the nozzle. The rotating brush likewise has lips at its outer periphery oriented to force dirty cleaning water towards the openings at the inner circumference of the nozzle.

5 Claims, 2 Drawing Sheets

APPARATUS FOR WET CLEANING OF FLOORS

The present invention relates to a compact, motor-driven apparatus for wet cleaning of floors.

At present, there is no suitable machine equipment for wet cleaning of floors available which would be appropriate for commercial use in today's environments, like on furnished premises, where existing cleaning equipment cannot be used because of its size. Further, the known scrubbing machines are characterized in that the scrubbing brushes are located separately from the suction nozzles. Usually, the suction nozzle is of rectangular shape and is located behind the scrubbing brushes, implying that after cleaning by means of these machines the floor is not completely dry.

U.S. Pat. No. 2,680,260 discloses a scrubbing machine with rotating brush and suction means. Above the brush and the suction means there are tanks for dirty and filtered water, a pump, a filter for dirty water and other components as well which makes the machine heavy and space-requiring and difficult to use in narrow spaces. Owing to the design of the mouth-piece surrounding the brush and the location of the suction means, the floor will not be dry after cleaning.

By means of the apparatus according to the invention, the above-mentioned disadvantages are avoided, since the apparatus is so compact, that it can be used also in small, for example, furnishes rooms and has the advantages of leaving the floor surface completely dry after cleaning. The special features of the apparatus according to the invention will be seen from the attached claims.

With reference to the accompanying drawings.

Figure 1:
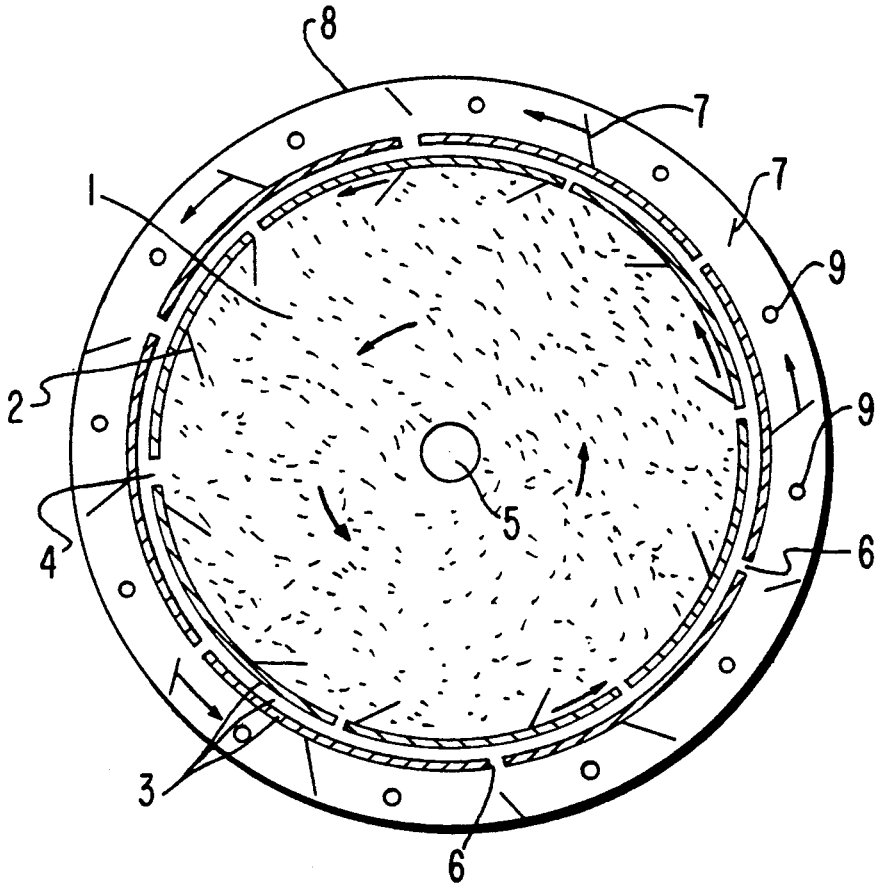
FIG. 1 shows the cleaning appliance viewed from below.
Figure 2:
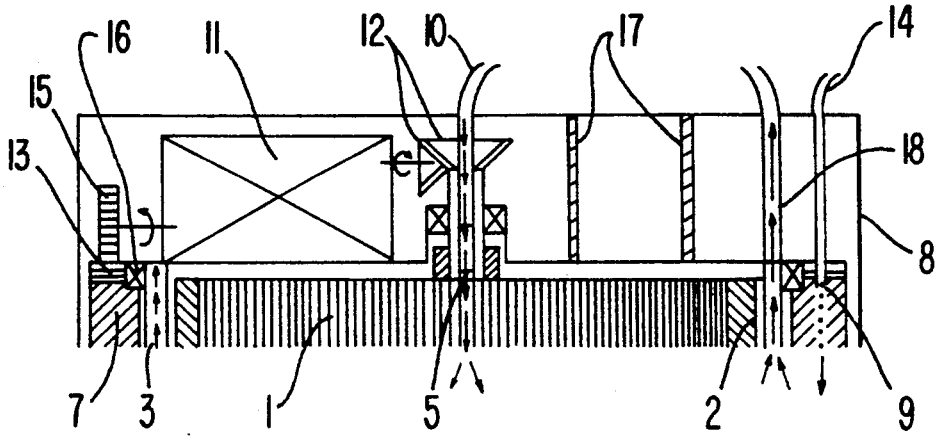
FIG. 2 is a vertical section of said appliance.
Figure 3:
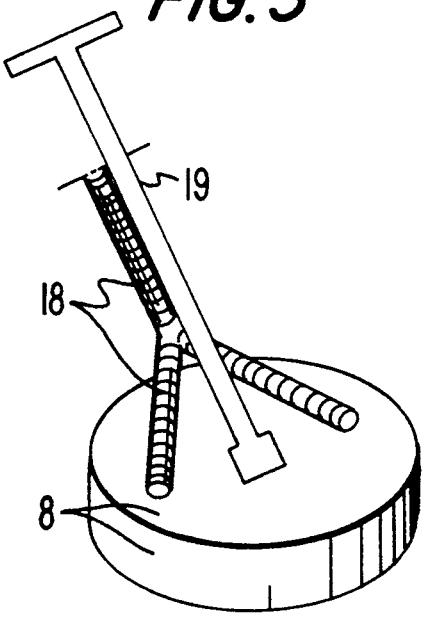
FIG. 3 shows the appliance provided with a handle and a hose and adapted to be connected to a water separator.

The apparatus according to the invention for wet cleaning of surfaces, such as floors and the like, has a centrally mounted, rotating, round scrubbing brush 1. Rotation is achieved by means of a connection 12 with a motor 11. In the centre of the scrubbing brush 1 there is an opening 5 for clean water containing detergent. By means of a hose or a tube 10, the opening is connected with a liquid supply.

Around the circumference of the scrubbing brush 1 there is mounted an annular suction nozzle 3, which in use of the apparatus is non-rotatable. Outside the outside circumference of the nozzle 3, there is a space, in the upper part of which there is mounted a ring 13 which is provided with a plurality of lips or flaps 7, or a plurality of fibres mounted in the ring 13 and extending to the floor, as well as with a plurality of openings 9 facing the floor for the supply of rinsing water to the floor surface outside the nozzle 3. The ring 13 is arranged to rotate in the same direction of rotation as the scrubbing brush 1 or in the opposite direction of rotation to the same. Rotation is achieved by means of the motor 11 and a connection 15. The rinsing water is obtained from a liquid supply by means of a flexible hose or a tube 14. The ring 13 is arranged to slide around the non-rotatable nozzle 3 via slide bearings 16. The nozzle 3, which is adapted to divert dirty cleaning water by means of suction effect, is provided with a plurality of radial openings 4, 6, some 4 of which are oriented inwardly towards the scrubbing brush 1 and some 6 of which are oriented outwardly towards the space located outside the nozzle 3, in which space the rotating ring 13 with the lips 7 and openings 9 is mounted. The openings 4, 6 are adapted to lead the dirty cleaning water and rinsing water to a hose 18, which by means of suction effect will force the liquid to a water separator or the like, in which the dirty cleaning water can be collected.

The cleaning water and rinsing water will be directed to the openings 4, 6 by lips 2 mounted on the outer part of the scrubbing brush 1 and by the lips 7 mounted in the space outside the nozzle 3. The lips 2, 7 are formed in such a way as to keep the openings 4, 6 free of dirt particles. The apparatus according to the invention is surrounded by a non-rotating protective casing 8 which has no contact with the floor and is fixedly connected to the nozzle 3 by means of a plurality of spacing rods 17. The compact apparatus according to the invention is operable by means of a handle 19 attached to the protective casing 8.

The apparatus functions in such a way that it supplies clean water containing detergent of a suitable kind to the scrubbing brush 1 inside the liquid nozzle 3 at the same time as supplying clean rinsing water to the outside of the liquid nozzle. The apparatus scrubs and rinses the floor surface and, as part of one and the same operation, sucks up the dirty cleaning water via the nozzle 3, leaving the floor surface clean and dry with no dirt marks on it. The apparatus, which is very compact, facilitates access to surfaces under tables, beds, bookcases etc. which are otherwise difficult to reach. The apparatus is easy to carry, for instance, up stairs.

We claim:

1. An apparatus for wet cleaning of floors and the like by means of a round rotating scrubbing brush (1) operated by a motor (11) and provided with a centrally mounted outlet (5) for clean water to which detergent of a suitable kind has been added, wherein around the scrubbing brush (1) there is mounted an annular, non-rotating nozzle (3) which by means of suction effect removes dirty cleaning water, characterized in that the nozzle (3) is provided with radial openings (4,6) some (4) of which are located at the inner circumference of the nozzle and oriented inwardly towards the scrubbing brush (1) and some (6) of which are located at the outer circumference of the nozzle and oriented outwardly towards a space arranged outside and around the nozzle (3), in the upper part of the space there being mounted a ring (13) which is rotatable by the motor (11) and provided with a plurality of openings (9) for rinsing water, the openings being oriented towards the floor, the ring also having a plurality of lips (7) extending therefrom to the floor, the lips being arranged to force, on rotation of the ring, the rinsing water towards the openings (6) at the outer circumference of the nozzle (3).

2. An apparatus according to claim 1, characterized in that around the apparatus there is mounted a non-rotating casing (8) provided with a handle (19), the casing having no contact with the floor and being fixedly mounted to the nozzle (3).

3. An apparatus according to claim 1, characterized in that the dirty cleaning water is to be removed by means of a hose (18).

4. An apparatus according to claim 1, characterized in that a plurality of second lips (2) extending to the floor are mounted at the circumference of the scrubbing brush (1) and arranged to force the dirty cleaning water towards the opening (4) located in the nozzle (3) and facing the scrubbing brush.

5. An apparatus according to claim 1, characterized in that the ring (13) may be driven in either direction of rotation relative to the scrubbing brush (1).

* * * * *